US012612222B1

(12) United States Patent
Li

(10) Patent No.: US 12,612,222 B1
(45) Date of Patent: Apr. 28, 2026

(54) DUAL-DRINK CUP LID WITH DETACHABLE STRAW AND CUP HAVING THE SAME

(71) Applicant: Zhejiang Shengjie Cup Industry Co., Ltd, Jinhua City (CN)

(72) Inventor: Youzhi Li, Zhaotong City (CN)

(73) Assignee: Zhejiang Shengjie Cup Industry Co., Ltd, Jinhua City (CN)

( * ) Notice: Subject to any disclaimer, the term of this patent is extended or adjusted under 35 U.S.C. 154(b) by 0 days.

(21) Appl. No.: 19/274,848

(22) Filed: Jul. 21, 2025

(30) Foreign Application Priority Data

May 26, 2025 (CN) ..... 202521040406.2

(51) Int. Cl.
*B65D 47/08* (2006.01)
*A47G 19/22* (2006.01)
*B65D 25/28* (2006.01)

(52) U.S. Cl.
CPC ..... *B65D 47/0895* (2013.01); *A47G 19/2222* (2013.01); *A47G 19/2272* (2013.01); *B65D 25/2811* (2013.01)

(58) Field of Classification Search
CPC ..... B65D 47/0895; B65D 25/2811; B65D 47/061; B65D 47/068; B65D 47/27; B65D 47/24; B65D 47/241; B65D 47/243; B65D 47/245; B65D 47/247; B65D 77/283; B65D 2543/00046; B65D 47/2062; B65D 2547/066; A47G 19/2222; A47G 19/2272; A47G 19/2266; A47G 21/18
See application file for complete search history.

(56) References Cited

U.S. PATENT DOCUMENTS

| | | | | |
|---|---|---|---|---|
| 2,355,010 | A * | 8/1944 | Pera | A47G 19/2266 220/756 |
| 6,092,647 | A * | 7/2000 | Yeh | F23Q 2/32 206/217 |
| 2014/0263377 | A1* | 9/2014 | Olmedo | B65D 77/283 220/708 |
| 2016/0264312 | A1* | 9/2016 | Choltco-Devlin | B65D 47/0895 |
| 2017/0225850 | A1* | 8/2017 | Sorensen | B65D 51/242 |
| 2021/0085110 | A1* | 3/2021 | Padgett | B65D 81/3879 |
| 2024/0092535 | A1* | 3/2024 | Bram | B65D 25/20 |
| 2024/0138603 | A1* | 5/2024 | Lixin | A47G 19/2272 |
| 2025/0136335 | A1* | 5/2025 | Harris | A47G 19/2288 |
| 2025/0178800 | A1* | 6/2025 | Gnesin | B65D 47/065 |
| 2025/0185829 | A1* | 6/2025 | Haskins | B65D 43/0227 |
| 2025/0296743 | A1* | 9/2025 | Yao | B65D 47/2062 |
| 2025/0304335 | A1* | 10/2025 | Wang | B65D 47/06 |

* cited by examiner

*Primary Examiner* — Don M Anderson
(74) *Attorney, Agent, or Firm* — Cooper Legal Group, LLC

(57) ABSTRACT

A dual-drink cup lid with a detachable straw, and a cup having the same. The dual-drink cup lid includes: a cup lid body, wherein a connection chamber and a direct-drink spout are arranged on the cup lid body; an inner straw assembly, detachably arranged on the cup lid body in a communication manner; a pressing seal assembly, movably arranged passing through the cup lid body and capable of being connected to or sealed with the inner straw assembly; an outer straw, detachably arranged on the pressing seal assembly in a communication manner; and a direct-drink lid plate, rotatably arranged on the cup lid body and detachably snapped onto the cup lid body; wherein the direct-drink spout is configured to be sealed via the direct-drink lid plate.

17 Claims, 8 Drawing Sheets

DUAL-DRINK CUP LID WITH DETACHABLE STRAW AND CUP HAVING THE SAME

CROSS-REFERENCE TO RELATED APPLICATIONS

The application claims priority of Chinese patent application CN202521040406.2, filed on May 26, 2025, which is incorporated herein by reference in its entireties.

TECHNICAL FIELD

The present disclosure relates to the technical field of cup lids, and more specifically to a dual-drink cup lid with a detachable straw, and a cup having the same.

BACKGROUND

Cups are routinely employed as vessels for containing liquids in daily life, primarily utilized for drinking water or beverages. As a significant category of cups, dual-drink cups typically feature a compartmentalized drinking port including a direct-drink spout and a sip-through port. This design accommodates diverse hydration preferences, facilitating both direct sipping (unmediated drinking) and straw-assisted suction (tubular ingestion). The direct-drink spout enables unassisted consumption, whereas the sip-through port integrates a detachable straw extending to the cup's bottom, optimizing accessibility for users, particularly children. In the related art, conventional dual-drink cups often permanently affix straws within the sip-through port, rendering them non-detachable. This configuration impedes replacement and thorough cleaning.

SUMMARY OF THE DISCLOSURE

A dual-drink cup lid with a detachable straw, including:

a cup lid body, wherein a connection chamber and a direct-drink spout are arranged on the cup lid body;

an inner straw assembly, detachably arranged on the cup lid body in a communication manner;

a pressing seal assembly, movably arranged passing through the cup lid body and capable of being connected to or sealed with the inner straw assembly;

an outer straw, detachably arranged on the pressing seal assembly in a communication manner; and a direct-drink lid plate, rotatably arranged on the cup lid body and detachably snapped onto the cup lid body; wherein the direct-drink spout is configured to be sealed via the direct-drink lid plate.

In some embodiments, the pressing seal assembly includes:

a fixed cylinder, fixedly snap-fit arranged in the connection chamber;

a pressing rod mechanism, movably arranged passing through the fixed cylinder and capable of limiting and being snap-fit connected to an inner wall of the fixed cylinder;

a pressing block, movably arranged passing through the fixed cylinder and in contact and connection with the pressing rod mechanism in a transmission manner; and an elastic member, disposed between the pressing rod mechanism and the connection chamber, providing a restoring force to the pressing rod mechanism.

In some embodiments, the pressing rod mechanism includes:

a pressing rod body, wherein the pressing rod body is a hollow tubular body that movably passes through the connection chamber and is in contact and connection with the pressing block in a transmission manner; the pressing rod body is detachably snap-fit connected to a plurality of limiting blocks on an inner wall of the fixed cylinder;

a first sealing member, fixedly arranged on a lower end of the pressing rod mechanism and configured to seal a joint portion between the connection chamber and the fixed cylinder; and a joint sleeve, fixedly arranged on an upper end of the pressing rod body; wherein the outer straw is detachably snap-fit arranged in the joint sleeve; wherein each of the plurality of limiting blocks has two locking positions of different heights, and the two locking positions are detachably snap-fit connected to the pressing rod body.

In some embodiments, the pressing rod body is fixedly surrounded by a plurality of inclined surfaces, and the plurality of inclined surfaces are correspondingly detachably snap-fit connected to the plurality of limiting blocks; a lower end of the pressing block is arranged with a plurality of conical bodies, and the plurality of conical bodies are correspondingly in contact and connection with the plurality of inclined surfaces in a transmission manner.

In some embodiments, an inner wall of the connection chamber defines a plurality of guide slots and a plurality of first snapping slots; a plurality of guide strips and a plurality of first latches are fixedly arranged on an outer side of the fixed cylinder; the plurality of guide strips are disposed in the plurality of guide slots, and the plurality of first latches are correspondingly fixedly connected to the plurality of first snapping slots by snap-fit.

In some embodiments, the inner straw assembly includes:

a connection head, detachably connected to a lower end of the connection chamber; and an inner straw body, fixedly connected to the connection head in a communication manner.

In some embodiments, the direct-drink lid plate is fixedly arranged with a second sealing member facing the direct-drink spout, and the second sealing member is detachably sealed on the direct-drink spout.

In some embodiments, a side of the direct-drink lid plate is fixedly arranged with a latch plate, and the latch plate protrudes from a side of the cup lid body.

A dual-drink cup with a detachable straw, including the dual-drink cup lid as above, a cup body, and a handle; wherein the dual-drink cup lid is detachably threaded onto the cup body, and the handle is fixedly arranged on a side of the cup body.

In some embodiments, the handle defines an accommodation cavity, and the outer straw is detachably arranged within the accommodation cavity; a handle cover is movably arranged on the accommodation cavity.

BRIEF DESCRIPTION OF THE DRAWINGS

To more clearly illustrate the technical solutions of the embodiments of the present disclosure, the following is a brief introduction to the drawings used in the description of the embodiments. It is obvious that the accompanying drawings merely illustrate certain embodiments of the present disclosure and should not be construed as limiting the scope thereof. For those skilled in the art, other related drawings may be obtained based on these drawings without creative labor.

DETAILED DESCRIPTION

Figure 1:
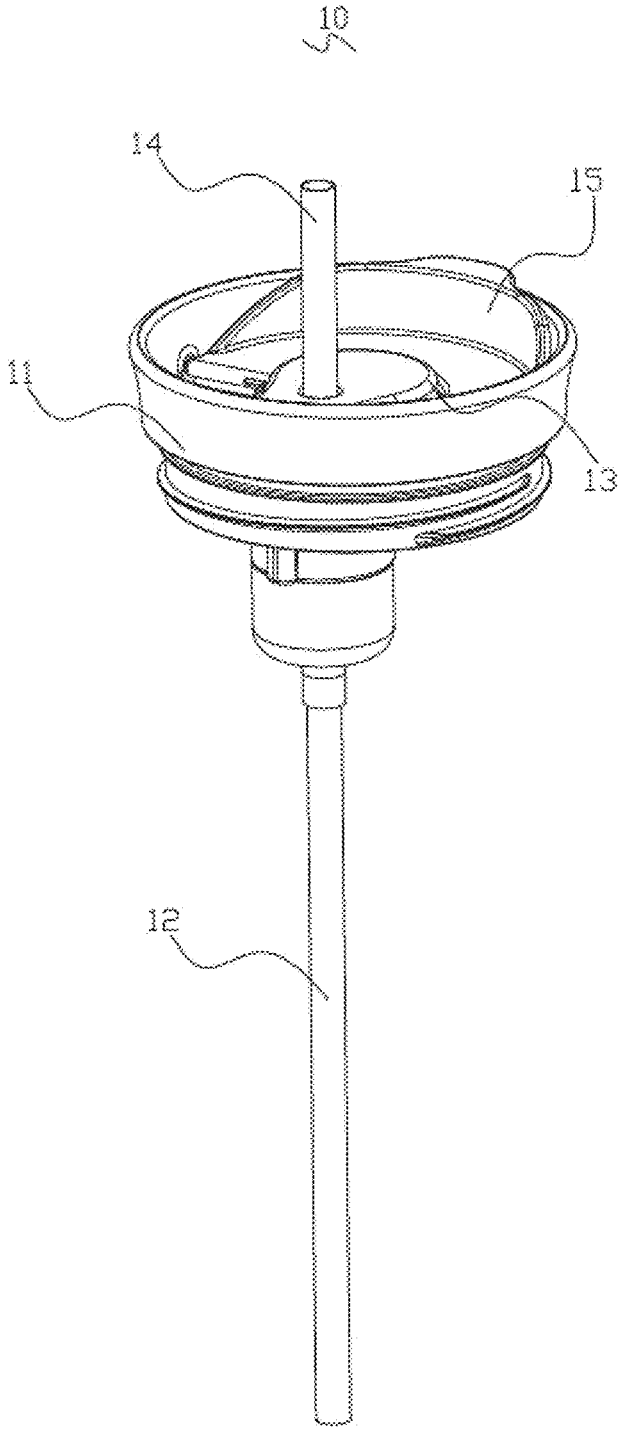
FIG. 1 is a perspective structural schematic view of a dual-drink cup lid with a detachable straw according to some embodiments of the present disclosure.

To make the objectives, technical solutions, and advantages of the embodiments of the present disclosure clearer, the technical solutions of the embodiments of the present disclosure will be described in detail below with reference to the accompanying drawings. It should be noted that the embodiments described herein are merely some embodiments of the present disclosure and not all embodiments. The components of the embodiments of the present disclosure described and shown in the accompanying drawings may be arranged and designed in different configurations.

Therefore, the detailed description of the embodiments of the present disclosure provided in the accompanying drawings is not intended to limit the scope of the disclosure as claimed, but merely represents selected embodiments of the present disclosure. All other embodiments obtained by those skilled in the art based on the embodiments of the present disclosure without making any creative contributions are within the scope of the present disclosure.

Referring to FIGS. 1-9, the present disclosure proposes a dual-drink cup lid 10 with a detachable straw, which mainly includes a cup lid body 11, an inner straw assembly 12, a pressing seal assembly 13, an outer straw 14, and a direct-drink lid plate 15; the cup lid body 11 is detachably arranged on a cup body 20; the inner straw assembly 12 is detachably arranged on the cup lid body 11 in a communication manner and is capable of extending into the cup body 20; the pressing seal assembly 13 is movably arranged passing through the cup lid body 11 and is capable of being connected to or sealed with the inner straw assembly 12; the outer straw 14 is detachably arranged on the pressing seal assembly 13 in a communication manner, and liquid in the cup body 20 is capable of being sucked through the outer straw 14, the pressing seal assembly 13, and the inner straw assembly 12 sequentially; the direct-drink lid plate 15 is rotatably arranged on the cup lid body 11 and is detachably snapped onto the cup lid body 11, where a direct-drink spout 114 on the cup lid body 11 is configured to be sealed via the direct-drink lid plate 15.

Referring to FIGS. 1-4, in the embodiments, an external thread 111 is arranged on an outer side of the cup lid body 11, and the cup lid body 11 is detachably threadedly connected to an opening of the cup body 20 via the external thread; the cup lid body 11 is arranged with a connection chamber 112, which is a hollow cavity open at both ends, and the inner straw assembly 12 is detachably arranged on one of the both ends of the connection chamber 112 in a communication manner; the cup lid body 11 symmetrically defines two rotational shaft holes 113, and two ends of the direct-drink lid plate 15 are rotatably connected to the two rotational shaft holes 113, enabling the direct-drink lid plate 15 to rotate relative to the cup lid body 11; the cup lid body 11 is arranged with the direct-drink spout 114 that extends through the cup lid body 11, and the direct-drink spout 114 is in communication with the cup body 20, allowing the direct-drink lid plate 15 to seal the direct-drink spout 114; a side wall of the cup lid body 11 further defines a second snapping slot 115, and the direct-drink lid plate 15 is detachably snap-fit connected to the second snapping slot 115, fixing the direct-drink lid plate 15 to the cup lid body 11 and ensuring fixed sealing of the direct-drink lid plate 15 on the direct-drink spout 114. Specifically, an inner wall of the connection chamber 112 defines multiple guide slots 1121, multiple first snapping slots 1122, and multiple limiting slots 1123.

Figure 2:
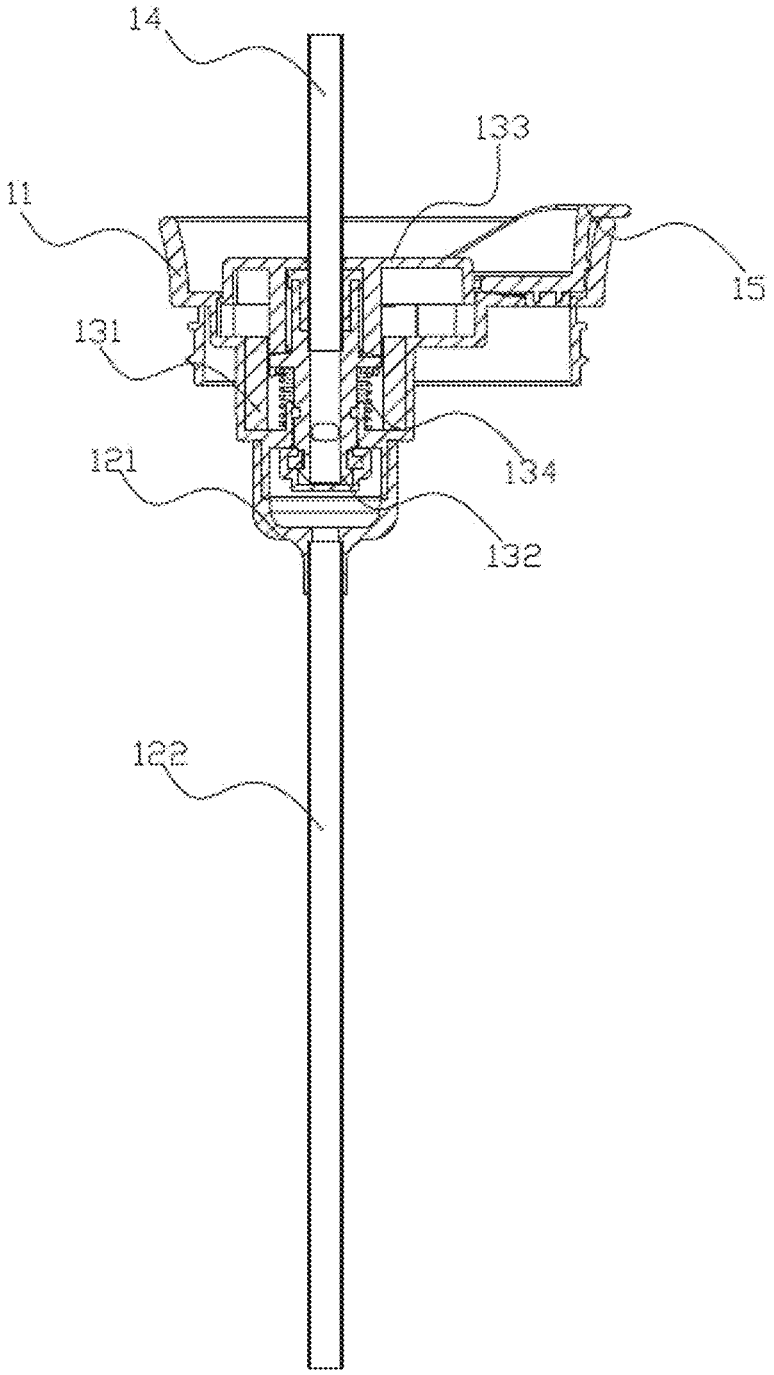
FIG. 2 is a longitudinal cross-sectional schematic view of a dual-drink cup lid with a detachable straw according to some embodiments of the present disclosure.
Figure 3:
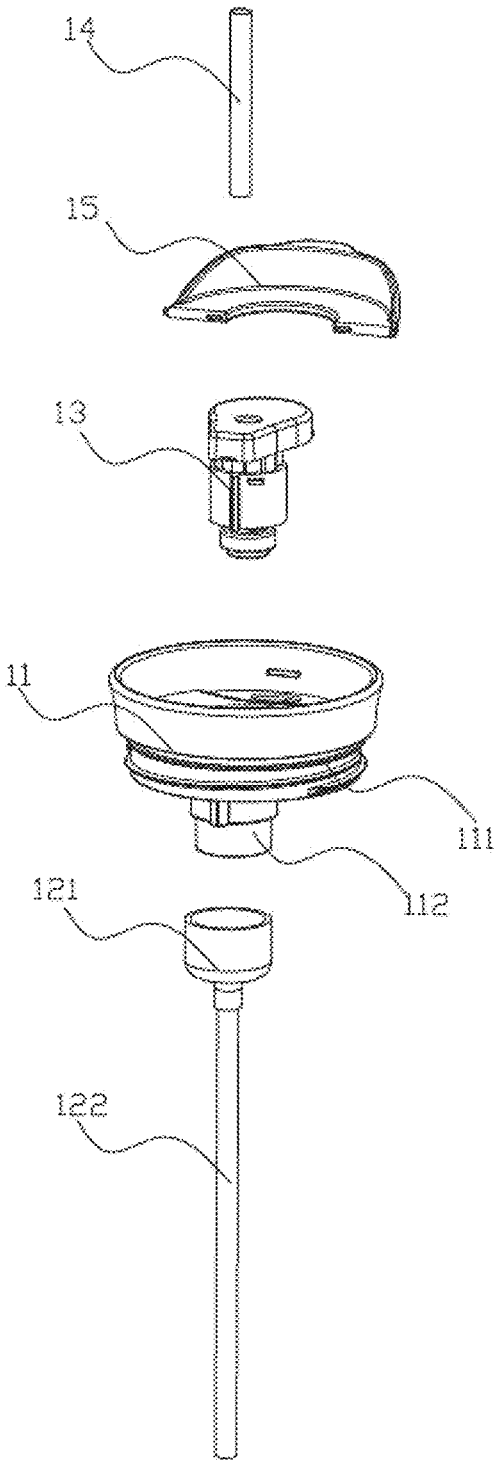
FIG. 3 is an exploded schematic view of a dual-drink cup lid with a detachable straw according to some embodiments of the present disclosure, including a cup lid body, a pressing seal assembly, and a direct-drink lid plate.
Figure 4:
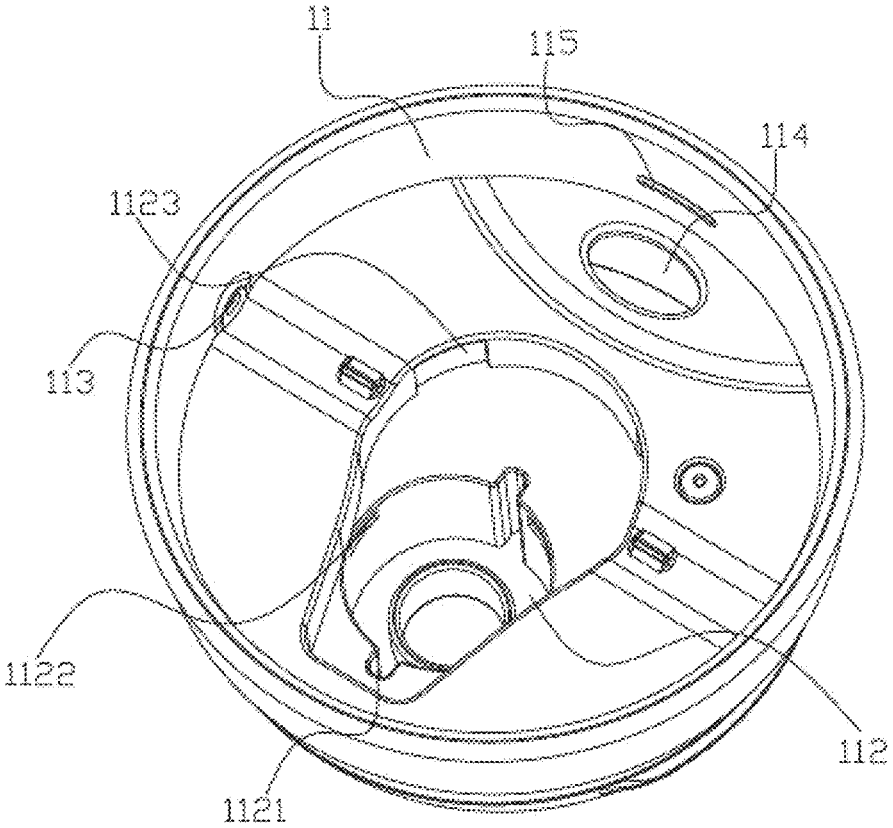
FIG. 4 is a perspective structural schematic view of the cup lid body as shown in FIG. 3.

Referring to FIGS. 1 to 3, in the embodiments, the inner straw assembly 12 includes a connection head 121 and an inner straw body 122; the connection head 121 is detachably connected to a lower end of the connection chamber 112; the inner straw body 122 is fixedly connected to the connection head 121 in a communication manner and capable of extending into the cup body 20.

Figure 5:
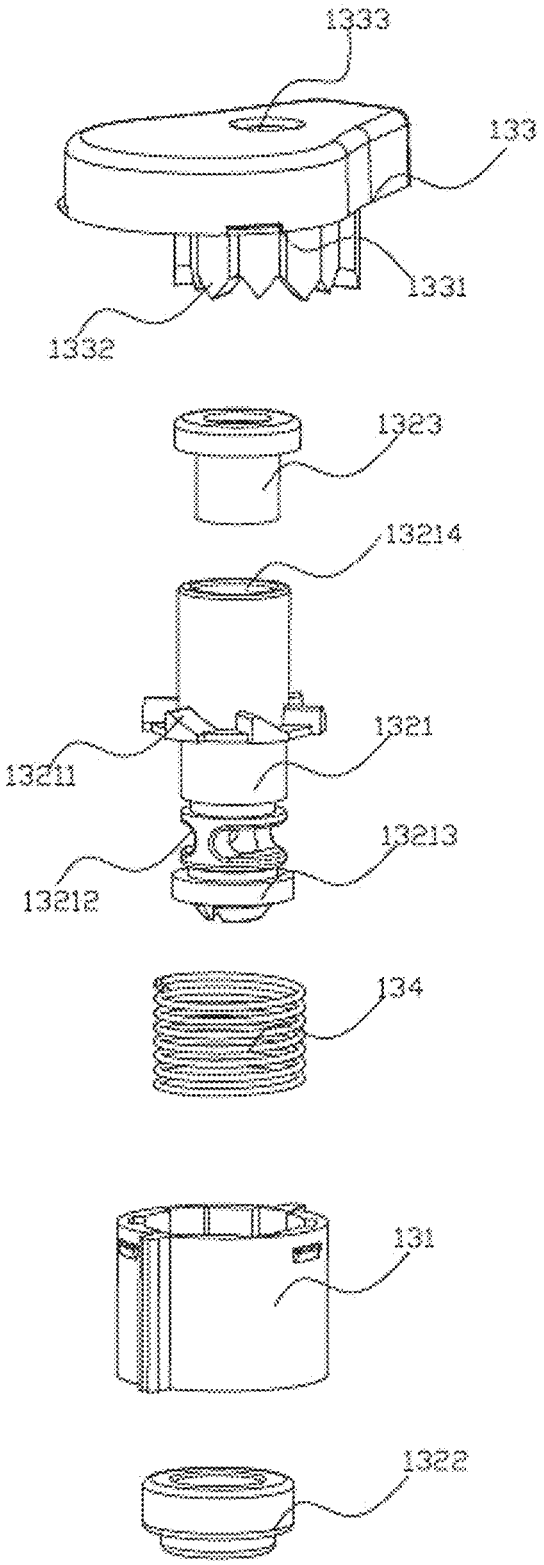
FIG. 5 is an exploded schematic view of the pressing seal assembly as shown in FIG. 3, including a fixed cylinder.

Referring to FIGS. 2, 3, and 5, in the embodiments, the pressing seal assembly 13 includes a fixed cylinder 131, a pressing rod mechanism 132, a pressing block 133, and an elastic member 134; the fixed cylinder 131 is fixedly snap-fit arranged in the connection chamber 112; the pressing rod mechanism 132 is movably arranged passing through the fixed cylinder 131 and capable of being snap-fit connected to an inner wall of the fixed cylinder 131, enabling communication or sealing of a joint portion between the fixed cylinder 131 and the connection head 121; when the pressing rod mechanism 132 performs a sealing operation on the joint portion between the fixed cylinder 131 and the connection head 121, the pressing rod mechanism 132 effectively prevents the liquid in the cup body 20 from leaking out through the inner straw assembly 12 and the fixed cylinder 131; the pressing block 133 is movably arranged passing through the fixed cylinder 131 and in contact and connection with the pressing rod mechanism 132 in a transmission manner, for driving the pressing rod mechanism 132 to move and enabling the communication or sealing of the joint portion between the fixed cylinder 131 and the connection head 121 by the pressing rod mechanism 132; the elastic member 134 is disposed between the pressing rod mechanism 132 and the connection chamber 112, providing a restoring force to the pressing rod mechanism 132. Specifically, the elastic member 134 may be a spring.

Figure 6:
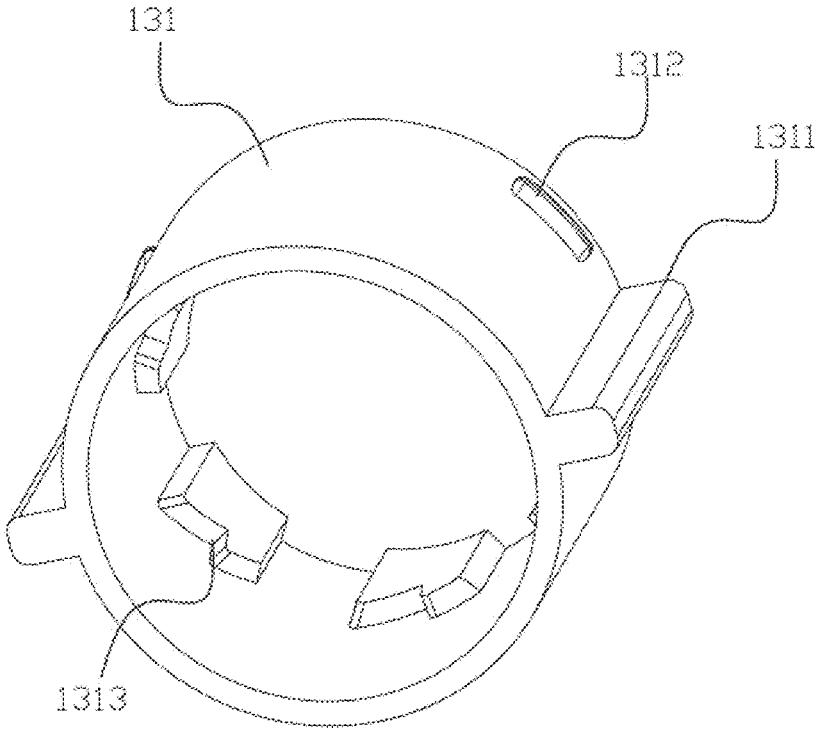
FIG. 6 is a perspective structural schematic view of the fixed cylinder as shown in FIG. 5.
Figure 7:
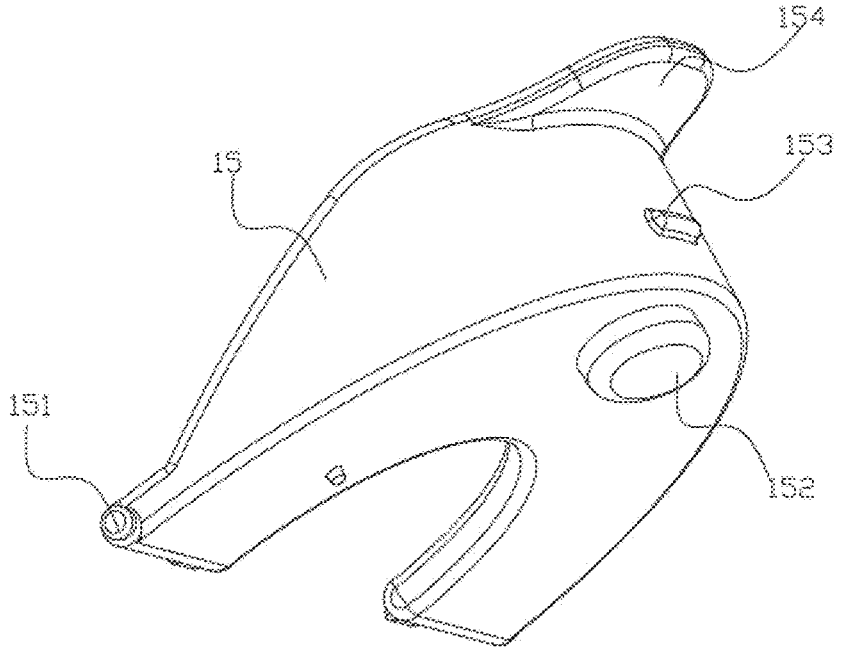
FIG. 7 is a perspective structural schematic view of the direct-drink lid plate as shown in FIG. 3.

Referring to FIGS. 2, 5, and 6, the fixed cylinder 131 is a cylindrical hollow cavity with open ends, and multiple guide strips 1311 and multiple first latches 1312 are fixedly arranged on an outer side of the fixed cylinder 131; the multiple guide strips 1311 are correspondingly disposed in the guide slots 1121, and the multiple first latches 1312 are correspondingly fixedly connected to the first snapping slots 1122 by snap-fit, thereby fixing the fixed cylinder 131 in the connection chamber 112; the inner wall of the fixed cylinder 131 is fixedly arranged with multiple limiting blocks 1313, each of which has two locking positions of different heights. The two locking positions can be detachably snap-fit connected to the pressing rod mechanism 132, thereby enabling the communication or sealing of the joint portion between the fixed cylinder 131 and the connection head 121 by the pressing rod mechanism 132.

Referring to FIGS. 2 and 5, in the embodiments, the pressing rod mechanism 132 includes a pressing rod body 1321, a first sealing member 1322, and a joint sleeve 1323; the pressing rod body 1321 is a hollow tubular body that movably passes through the connection chamber 112 and is in contact and connection with the pressing block 133 in a transmission manner, where the pressing rod body 1321 is detachably snap-fit connected to the multiple limiting blocks 1313; the first sealing member 1322 is fixedly arranged on a lower end of the pressing rod mechanism 132 and configured to seal a joint portion between the connection chamber 112 and the fixed cylinder 131; the joint sleeve 1323 is fixedly arranged on an upper end of the pressing rod body 1321, and an end of the outer straw 14 is detachably snap-fit arranged in the joint sleeve 1323, thereby enabling the sealed communication connection between the outer straw 14 and the pressing rod body 1321. Specifically, the pressing rod body 1321 is fixedly surrounded by multiple inclined surfaces 13211, and the multiple inclined surfaces 13211 are respectively in contact and connection with the pressing block 133 in a transmission manner and are detachably snap-fit connected to the limiting blocks 1313; a lower end of the pressing rod body 1321 defines at least one liquid inlet hole 13212 that passes through the lower end, and the liquid sucked from the inner straw assembly 12 enters the pressing rod body 1321 through the at least one liquid inlet hole 13212; for opposite both ends of the pressing rod body 1321, one end is arranged with a connection portion 13213 and the other end is arranged with a joint sleeve nozzle 13214. The first sealing member 1322 is detachably connected to the connection portion 13213, and the joint sleeve 1323 is arranged passing through the joint sleeve nozzle 13214. In some embodiments, the first sealing member 1322 and the joint sleeve 1323 are made of silicone rubber.

Referring to FIG. 5, in the embodiments, the pressing block 133 is movably arranged on an upper end of the fixed cylinder 131 and capable of being in contact and connection with the multiple inclined surfaces 13211 in a transmission manner. Specifically, a side of the pressing block 133 is arranged with multiple snapping blocks 1331, and the multiple snapping blocks 1331 are correspondingly movably arranged in the limiting slots 1123. The snapping blocks 1331 are limited by the limiting slots 1123 to prevent the pressing block 133 from disconnecting from the fixed cylinder 131. A lower end of the pressing block 133 is arranged with multiple conical bodies 1332, and the multiple conical bodies 1332 are correspondingly in contact and connection with the inclined surfaces 13211 in a transmission manner, driving the pressing rod mechanism 132 to form a detachable snap-fit connection with the multiple limiting blocks 1313, thereby achieving the length adjustability of the pressing rod mechanism 132. Its working principle and structure are similar to those of an elastic ballpoint pen. The pressing block 133 defines a straw hole 1333 passing through the pressing block 133, and the outer straw 14 is connected to the joint sleeve 1323 through the straw hole 1333.

Referring to FIGS. 1, 2, 3, and 7, in the embodiments, the opposite ends of the direct-drink lid plate 15 are each arranged with a rotational shaft 151, and the two rotational shafts 151 are correspondingly rotatably arranged in the two rotational shaft holes 113; the direct-drink lid plate 15 is fixedly arranged with a second sealing member 152 facing the direct-drink spout 114, and the second sealing member 152 is detachably sealed on the direct-drink spout 114, thereby completing the sealing of the direct-drink spout 114; the direct-drink lid plate 15 is arranged with a second latch 153 to match with the second snapping slot 115, and the second latch 153 is detachably snap-fit arranged in the second snapping slot 115, thereby fixing the direct-drink lid plate 15 to the cup lid body 11; a side of the direct-drink lid plate 15 is fixedly arranged with a latch plate 154, which protrudes from a side of the cup lid body 11, allowing the direct-drink lid plate 15 to be easily opened via the latch plate 154.

Figure 8:
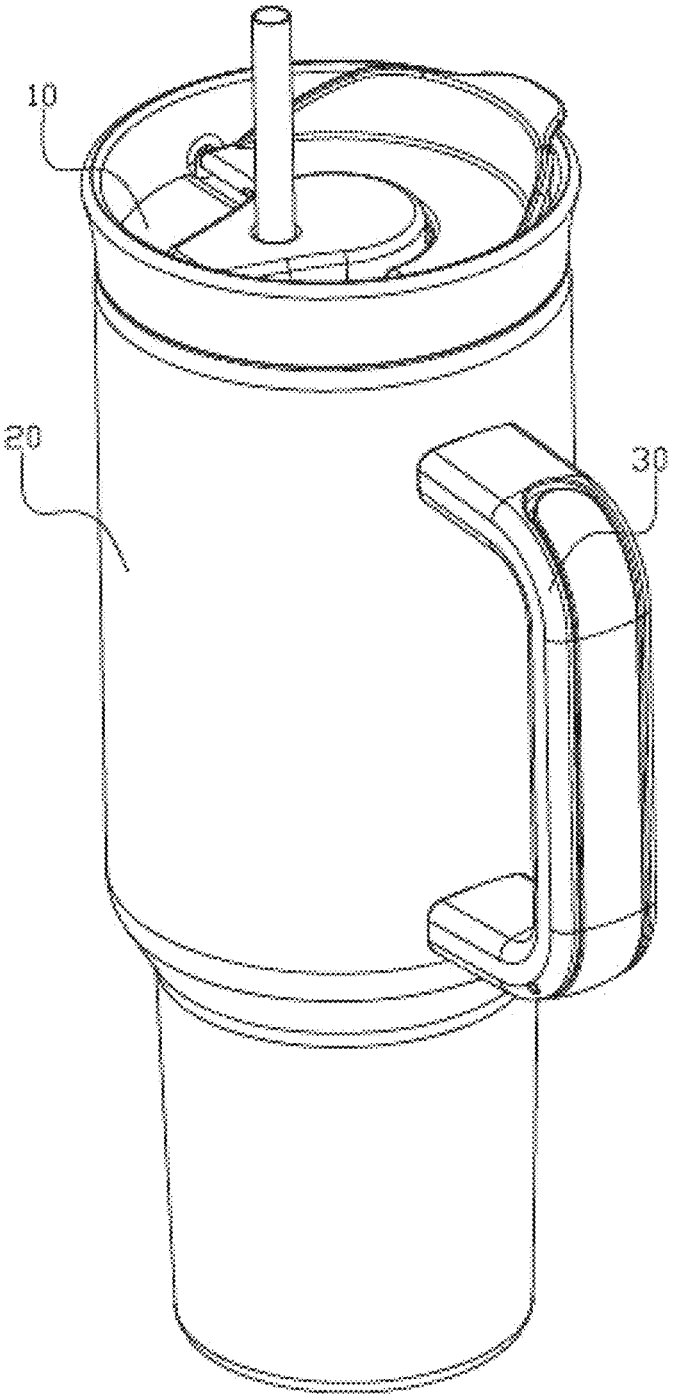
FIG. 8 is a perspective structural schematic view of a dual-drink cup with a detachable straw according to some embodiments of the present disclosure in a first usage state.
Figure 9:
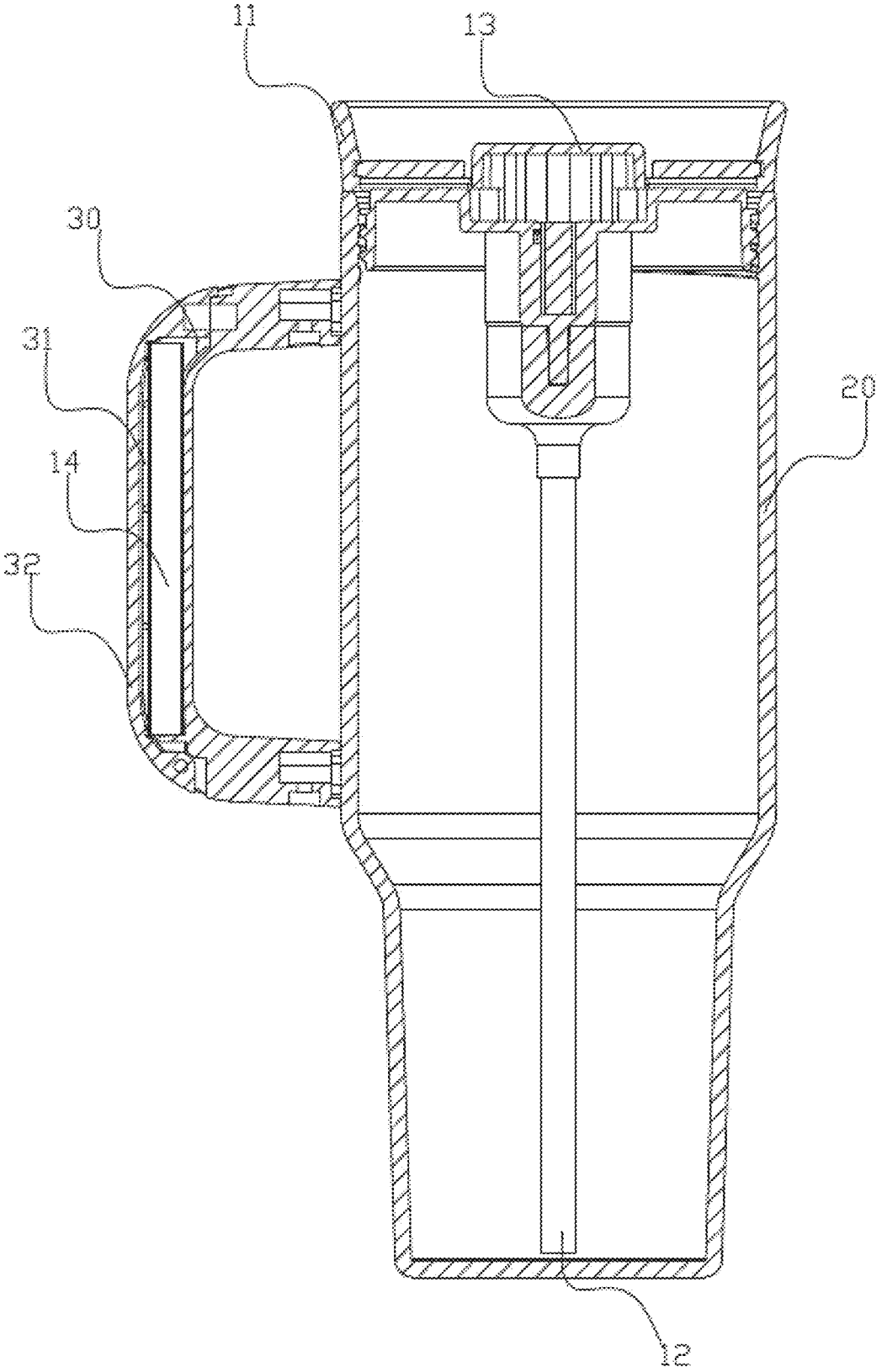
FIG. 9 is a perspective structural schematic view of a dual-drink cup with a detachable straw according to some embodiments of the present disclosure in a second usage state.

Referring to FIGS. 8 and 9, the present disclosure further proposes a cup with a detachable straw, including the dual-drink cup lid 10 in any of the above embodiments, a cup body 20, and a handle 30; the cup body 20 is a main body for holding liquid, and the dual-drink cup lid 10 is detachably threaded onto the cup body 20, allowing direct drinking or sipping of liquid from the cup body 20 through the dual-drink cup lid 10; the handle 30 is fixedly arranged on a side of the cup body 20, allowing the cup to be easily held for direct drinking or sipping operations. Specifically, the handle 30 defines an accommodation cavity 31, and the outer straw 14 is detachably arranged within the accommodation cavity 31; a handle cover 32 is movably arranged on the accommodation cavity 31, forming a hollow sealed cavity to protect the outer straw 14 arranged therein.

It should be noted that the specific operating process of the proposed dual-drink cup lid and cup is as follows: when it is necessary to directly drink the liquid in the cup body 20, the direct-drink lid plate 15 may be opened, and the liquid in the cup body 20 may be directly drunk through the direct-drink spout 114, thereby completing the direct drinking operation; when it is necessary to suck the liquid from the cup body 20, the outer straw 14 may first be taken from the accommodation cavity 31 and connected to the pressing rod mechanism 132 through the straw hole 1333, then external force is applied to the pressing block 133, causing the pressing block 133 to move downward for releasing the sealing of the pressing rod mechanism 132 on the joint portion between the fixed cylinder 131 and the connection head 121; then, by sucking the outer straw 14 forcefully, the liquid in the cup body 20 flows sequentially through the inner straw body 122, the connection head 121, the liquid inlet hole 12312, the pressing rod body 1231, the joint sleeve 1323, and into the outer straw 14, thereby completing the suction and drinking operation.

The technical features of the above-described embodiments may be combined in any manner. For the sake of simplicity, not all possible combinations of the technical features in the embodiments are described. However, as long as there is no contradiction between the combinations of these technical features, they should be considered to be within the scope of this specification.

The above embodiments only express several implementation methods of the present disclosure, and their descriptions are relatively specific and detailed, but they should not be understood as limiting the scope of the present disclosure. For those skilled in the art, without departing from the concept of the present disclosure, modifications and improvements may be made, which are all within the scope of the present disclosure. Therefore, the scope of the present disclosure should be based on the attached claims.

What is claimed is:

1. A dual-drink cup lid with a detachable straw, comprising:

a cup lid body, wherein a connection chamber and a direct-drink spout are arranged on the cup lid body;

an inner straw assembly, detachably arranged on the cup lid body in a communication manner;

a pressing seal assembly, movably arranged passing through the cup lid body and capable of being connected to or sealed with the inner straw assembly;

an outer straw, detachably arranged on the pressing seal assembly in a communication manner; and a direct-drink lid plate, rotatably arranged on the cup lid body and detachably snapped onto the cup lid body; wherein the direct-drink spout is configured to be sealed via the direct-drink lid plate;

wherein the pressing seal assembly comprises:

a fixed cylinder, fixedly snap-fit arranged in the connection chamber;

a pressing rod mechanism, movably arranged passing through the fixed cylinder and capable of being snap-fit connected to an inner wall of the fixed cylinder;

a pressing block, movably arranged passing through the fixed cylinder and in contact and connection with the pressing rod mechanism in a transmission manner; and an elastic member, disposed between the pressing rod mechanism and the connection chamber, providing a restoring force to the pressing rod mechanism.

2. The dual-drink cup lid according to claim 1, wherein the pressing rod mechanism comprises:

a pressing rod body, wherein the pressing rod body is a hollow tubular body that movably passes through the connection chamber and is in contact and connection with the pressing block in a transmission manner; the pressing rod body is detachably snap-fit connected to a plurality of limiting blocks on the inner wall of the fixed cylinder;

a first sealing member, fixedly arranged on a lower end of the pressing rod mechanism and configured to seal a joint portion between the connection chamber and the fixed cylinder; and a joint sleeve, fixedly arranged on an upper end of the pressing rod body; wherein the outer straw is detachably snap-fit arranged in the joint sleeve; wherein each of the plurality of limiting blocks has two locking positions of different heights, and the two locking positions are detachably snap-fit connected to the pressing rod body.

3. The dual-drink cup lid according to claim 2, wherein the pressing rod body is fixedly surrounded by a plurality of inclined surfaces, and the plurality of inclined surfaces are correspondingly detachably snap-fit connected to the plurality of limiting blocks; a lower end of the pressing block is arranged with a plurality of conical bodies, and the plurality of conical bodies are correspondingly in contact and connection with the plurality of inclined surfaces in a transmission manner.

4. The dual-drink cup lid according to claim 1, wherein an inner wall of the connection chamber defines a plurality of guide slots and a plurality of first snapping slots; a plurality of guide strips and a plurality of first latches are fixedly arranged on an outer side of the fixed cylinder; the plurality of guide strips are disposed in the plurality of guide slots, and the plurality of first latches are correspondingly fixedly connected to the plurality of first snapping slots by snap-fit.

5. The dual-drink cup lid according to claim 1, wherein the inner straw assembly comprises:

a connection head, detachably connected to a lower end of the connection chamber; and an inner straw body, fixedly connected to the connection head in a communication manner.

6. The dual-drink cup lid according to claim 2, wherein the direct-drink lid plate is fixedly arranged with a second sealing member facing the direct-drink spout, and the second sealing member is detachably sealed on the direct-drink spout.

7. The dual-drink cup lid according to claim 1, wherein a side of the direct-drink lid plate is fixedly arranged with a latch plate, and the latch plate protrudes beyond a side of the cup lid body.

8. A dual-drink cup, comprising the dual-drink cup lid of claim 1, a cup body, and a handle;

wherein the dual-drink cup lid is detachably threaded onto the cup body, and the handle is fixedly arranged on a side of the cup body.

9. The dual-drink cup according to claim 8, wherein the handle defines an accommodation cavity, and the outer straw is capable of being detachably arranged within the accommodation cavity; a handle cover is movably arranged on the accommodation cavity.

10. The dual-drink cup according to claim 8, wherein the pressing rod mechanism comprises:

a pressing rod body, wherein the pressing rod body is a hollow tubular body that movably passes through the connection chamber and is in contact and connection with the pressing block in a transmission manner; the pressing rod body is detachably snap-fit connected to a plurality of limiting blocks on the inner wall of the fixed cylinder;

a first sealing member, fixedly arranged on a lower end of the pressing rod mechanism and configured to seal a joint portion between the connection chamber and the fixed cylinder; and a joint sleeve, fixedly arranged on an upper end of the pressing rod body; wherein the outer straw is detachably snap-fit arranged in the joint sleeve; wherein each of the plurality of limiting blocks has two locking positions of different heights, and the two locking positions are detachably snap-fit connected to the pressing rod body.

11. The dual-drink cup according to claim 10, wherein the pressing rod body is fixedly surrounded by a plurality of inclined surfaces, and the plurality of inclined surfaces are correspondingly detachably snap-fit connected to the plurality of limiting blocks; a lower end of the pressing block is arranged with a plurality of conical bodies, and the plurality of conical bodies are correspondingly in contact and connection with the plurality of inclined surfaces in a transmission manner.

12. The dual-drink cup according to claim 8, wherein an inner wall of the connection chamber defines a plurality of guide slots and a plurality of first snapping slots; a plurality of guide strips and a plurality of first latches are fixedly arranged on an outer side of the fixed cylinder; the plurality of guide strips are disposed in the plurality of guide slots, and the plurality of first latches are correspondingly fixedly connected to the plurality of first snapping slots by snap-fit.

13. The dual-drink cup according to claim 8, wherein the inner straw assembly comprises:

a connection head, detachably connected to a lower end of the connection chamber; and an inner straw body, fixedly connected to the connection head in a communication manner.

14. The dual-drink cup according to claim 10, wherein the direct-drink lid plate is fixedly arranged with a second sealing member facing the direct-drink spout, and the second sealing member is detachably sealed on the direct-drink spout.

15. The dual-drink cup according to claim 8, wherein a side of the direct-drink lid plate is fixedly arranged with a latch plate, and the latch plate protrudes beyond a side of the cup lid body.

16. A dual-drink cup lid with a detachable straw, comprising:

a cup lid body, wherein a connection chamber and a direct-drink spout are arranged on the cup lid body;

an inner straw assembly, detachably arranged on the cup lid body in a communication manner;

a pressing seal assembly, movably arranged passing through the cup lid body and capable of being connected to or sealed with the inner straw assembly;

an outer straw, detachably arranged on the pressing seal assembly in a communication manner; and a direct-drink lid plate, rotatably arranged on the cup lid body and detachably snapped onto the cup lid body; wherein the direct-drink spout is configured to be sealed via the direct-drink lid plate;

wherein an inner wall of the connection chamber defines a plurality of guide slots and a plurality of first snapping slots; a plurality of guide strips and a plurality of first latches are fixedly arranged on an outer side of a fixed cylinder of the pressing seal assembly; the plurality of guide strips are disposed in the plurality of guide slots, and the plurality of first latches are correspondingly fixedly connected to the plurality of first snapping slots by snap-fit.

17. A dual-drink cup, comprising a dual-drink cup lid with a detachable straw, a cup body, and a handle;

wherein the dual-drink cup lid is detachably threaded onto the cup body, and the handle is fixedly arranged on a side of the cup body;

wherein the dual-drink cup comprises:

a cup lid body, wherein a connection chamber and a direct-drink spout are arranged on the cup lid body;

an inner straw assembly, detachably arranged on the cup lid body in a communication manner;

a pressing seal assembly, movably arranged passing through the cup lid body and capable of being connected to or sealed with the inner straw assembly;

an outer straw, detachably arranged on the pressing seal assembly in a communication manner; and a direct-drink lid plate, rotatably arranged on the cup lid body and detachably snapped onto the cup lid body; wherein the direct-drink spout is configured to be sealed via the direct-drink lid plate;

wherein an inner wall of the connection chamber defines a plurality of guide slots and a plurality of first snapping slots; a plurality of guide strips and a plurality of first latches are fixedly arranged on an outer side of a fixed cylinder of the pressing seal assembly; the plurality of guide strips are disposed in the plurality of guide slots, and the plurality of first latches are correspondingly fixedly connected to the plurality of first snapping slots by snap-fit.

* * * * *